US006983961B2

(12) United States Patent
Aduana, Jr. et al.

(10) Patent No.: US 6,983,961 B2
(45) Date of Patent: Jan. 10, 2006

(54) NECKTIE-KNOTTING DEVICE AND METHOD

(76) Inventors: Efren B. Aduana, Jr., 3609 S. Francisco Ave., Chicago, IL (US) 60632; Rommel B. Aduana, 3609 S. Francisco Ave., Chicago, IL (US) 60632; Gleen B. Aduana, 1357 N. Artesian Ave., Chicago, IL (US) 60622

( * ) Notice: Subject to any disclaimer, the term of this patent is extended or adjusted under 35 U.S.C. 154(b) by 1 day.

(21) Appl. No.: 10/690,677

(22) Filed: Oct. 22, 2003

(65) Prior Publication Data

US 2005/0087986 A1 Apr. 28, 2005

(51) Int. Cl.
*D03J 3/00* (2006.01)

(52) U.S. Cl. ..... 289/17; 289/1.5; 289/18.1

(58) Field of Classification Search ..... 289/2, 289/1.5, 17, 18.1; 223/81, 82, DIG. 1, 88, 223/91, 92; 434/400; 2/52, 144, 148, 152.1, 2/157

See application file for complete search history.

(56) References Cited

U.S. PATENT DOCUMENTS

| | | | | | |
|---|---|---|---|---|---|
| 1,040,181 | A | * | 10/1912 | Frank | 223/92 |
| 1,300,321 | A | | 4/1919 | Wofford | 2/153 |
| 1,367,461 | A | | 2/1921 | Caumont | 2/153 |
| 1,456,622 | A | | 5/1923 | Crause | |
| 2,209,468 | A | * | 7/1940 | Nathan | 223/91 |
| 2,269,769 | A | | 1/1942 | Kennedy | 2/153 |
| 2,271,067 | A | | 1/1942 | Fruns | 2/153 |
| 2,450,471 | A | | 10/1948 | Dorkin | 2/144 |
| D159,554 | S | * | 8/1950 | Simon | D6/318 |
| 2,628,360 | A | | 2/1953 | Kush | 2/153 |
| 2,710,408 | A | * | 6/1955 | Lackland | 2/153 |
| 2,713,170 | A | | 7/1955 | Block | 2/153 |
| 2,733,447 | A | | 2/1956 | Kuriyama | 2/153 |
| D188,578 | S | * | 8/1960 | Zuckerman | D6/319 |
| 2,958,870 | A | | 11/1960 | Johnson | 2/153 |
| 2,972,749 | A | | 2/1961 | Gruber | 2/153 |
| D195,017 | S | * | 4/1963 | Wilhelm | D6/315 |
| 3,171,576 | A | * | 3/1965 | Graham | 223/88 |
| D219,692 | S | * | 1/1971 | Kufchock | D6/319 |
| 3,710,993 | A | * | 1/1973 | Collin | 223/91 |
| 3,752,374 | A | | 8/1973 | Pro | 223/111 |
| 3,887,079 | A | * | 6/1975 | Crew | 211/118 |
| 4,173,793 | A | * | 11/1979 | Kazuo | 2/146 |
| 4,474,316 | A | | 10/1984 | Philibert | 223/88 |
| 4,582,233 | A | * | 4/1986 | Brickhouse | 223/88 |
| 4,632,285 | A | * | 12/1986 | Dillingham | 223/88 |
| 4,815,772 | A | | 3/1989 | Lizarraga | 289/1 |
| 5,390,370 | A | | 2/1995 | Koy | 2/152 |
| 5,562,456 | A | | 10/1996 | Cianciotto | 434/260 |

(Continued)

*Primary Examiner*—Gary L. Welch
(74) *Attorney, Agent, or Firm*—Walter J. Tencza, Jr.

(57) ABSTRACT

An improved necktie knotting device and method. The typical embodiment of the device is comprised of a first member which can be called a collar may have first and second indentations that serve as an anchor for the tie. The second indentation may be opposite the first indentation. Second and third members may be provided which may be arranged in a Y-shape configuration and be comprised of two separate symmetrical parts each having an upper portion called an arm and lower portion called a handle. The second member is connected to the first member. The second member and third member are typically made of a resilient metal wire. The meeting portion of the second and third member is where the tie is knotted. The tie loop is created by running the tie on the first member and the device tie knot point.

18 Claims, 10 Drawing Sheets

U.S. PATENT DOCUMENTS

| | | | | |
|---|---|---|---|---|
| 5,577,778 | A | 11/1996 | Parietti et al. | 289/17 |
| 5,601,318 | A | 2/1997 | Rusing | 289/17 |
| 5,642,841 | A | 7/1997 | Beaty | 223/85 |
| 5,692,241 | A | 12/1997 | Helfer | 2/152 |
| D394,557 | S | 5/1998 | Wilcox | D6/318 |
| 5,864,881 | A | 2/1999 | Simmons | 2/145 |
| 6,015,172 | A | 1/2000 | Williams et al. | 289/2 |
| 6,120,068 | A | 9/2000 | DiPietro | 289/17 |
| 6,202,905 | B1 | 3/2001 | Heide | 223/94 |
| 6,435,571 | B1 | 8/2002 | Parietti | 289/17 |
| 6,543,819 | B2 | 4/2003 | Hakimain | 289/2 |

* cited by examiner

NECKTIE-KNOTTING DEVICE AND METHOD

FIELD OF THE INVENTION

This invention relates to improved methods and apparatus concerning tying a necktie.

BACKGROUND OF THE INVENTION

This invention relates to neckties, and in particular to a device used to form a tie knot.

Neckties are an important part of men's clothing. Different makes of neckties are manufactured and sold for different occasions. The ability to choose a tie for a particular occasion, form the desired knot and achieve the desired lengths of the narrow and broad part of the tie is an indispensable ability.

Three of the most popular tie knot styles are four-in-hand, half-Windsor and Windsor knot. Tying a necktie on ourselves is often time consuming and frustrating especially if we are in a hurry since the tie is always the last thing we put on after putting on, for example, a suit. Most of the time we tend to repeat tying the knot several times until the tie gets wrinkled. This happens because it is usually easier to tie someone else's tie than to knot a tie on ourselves. For example, a wife may end up knotting her husband's tie.

Some of those already wearing their tie may just loosen their tie without unraveling the knot to wear this at a later time and in a hurry.

Other design of ties such as the clip-on and other easy attachment ties that have the preformed knots were developed to hasten the wearing of a tie. While some are using these preformed ties, they are not very much accepted. Most men still like to use the usual neckties.

Several patents for forming necktie knots have been disclosed. Of particular importance to the present invention is the U.S. Pat. No. 6,120,068, issued Sep. 19, 2000 to N. DiPietro. This patent includes a cylindrical body, a means connected to the body for holding the necktie in position while the necktie is being worn, and two projecting and divergent elongated elements protruding from one end of the cylindrical body wherein the said elements provide wrap assist elements for knot formation. The steps of knotting the tie comprise the step of placing the tie around the collar of the wearer with the wider free end section crossed over the narrower free end section. The knot forming apparatus is then moved into place at the cross over point between the wider free end section over the apparatus top between the divergent element following the method of knotting discussed in the patent. After the tie is knotted, the apparatus is then removed from the tie knot by sliding the apparatus downward away from the tie knot.

The main disadvantage of the above mentioned patent is that while it may form the tie knot, it may be cumbersome for the wearer to use the device, wherein the use of the device is comprised of placing the device on the wearer's collar and at the same time knotting the tie. The complexity of using the apparatus in performing a simple task may not be what the user wants.

Thus, an improved knot forming apparatus that combines simplicity of use and has other uses is desirable.

SUMMARY OF THE INVENTION

The present invention provides an improved necktie knotting apparatus and method. The present invention in one or more embodiments provides one or more apparatus that can be used to knot a necktie for immediate use, for store displays, or as a teaching tool. The present invention can be useful for people who wear neckties to work, store employees who knot neckties for store displays, and for new users who want to learn how to knot or tie a necktie.

In one embodiment, an apparatus is provided comprising a hanger, a first member, a second member, and a third member. This embodiment or part of this embodiment may be said to be arranged in an inverted-delta configuration. In one embodiment, the first member, which can be called a collar, may have a first and a second indentation that together serve as an anchor for a tie. The second indentation may be opposite the first indentation. The second and third member may be arranged in a Y-shape configuration and may be comprised of two separate symmetrical parts each having an upper portion called an arm and a lower portion called a handle. The upper part of each of the arms is connected to the collar. The hanger may be connected to the collar. The collar may have a means of hanging the tie before it is knotted. In another embodiment, the first member, which can be called a collar, may have a first and second indentation that together serve as an anchor for the tie. The configuration of this embodiment may be called a "T configuration". The second and third members are substantially straight wherein the second member is called the spine and the third member is called the handle. The upper part is connected to the middle part of the collar. In yet, in another embodiment, which may be called a "channel-configuration", the collar is in the shape of a channel that serves as an anchor for the device and bent symmetrical shape wire mentioned in the first embodiment. In all embodiments, the meeting point of the first member and the second member is called the device tie knot point. A tie loop is created by fixing a certain length of a narrow end of the tie in the device tie knot point and running a broad tie end on the collar and back to the device tie knot point.

DETAILED DESCRIPTION OF THE DRAWINGS

Figure 1A:
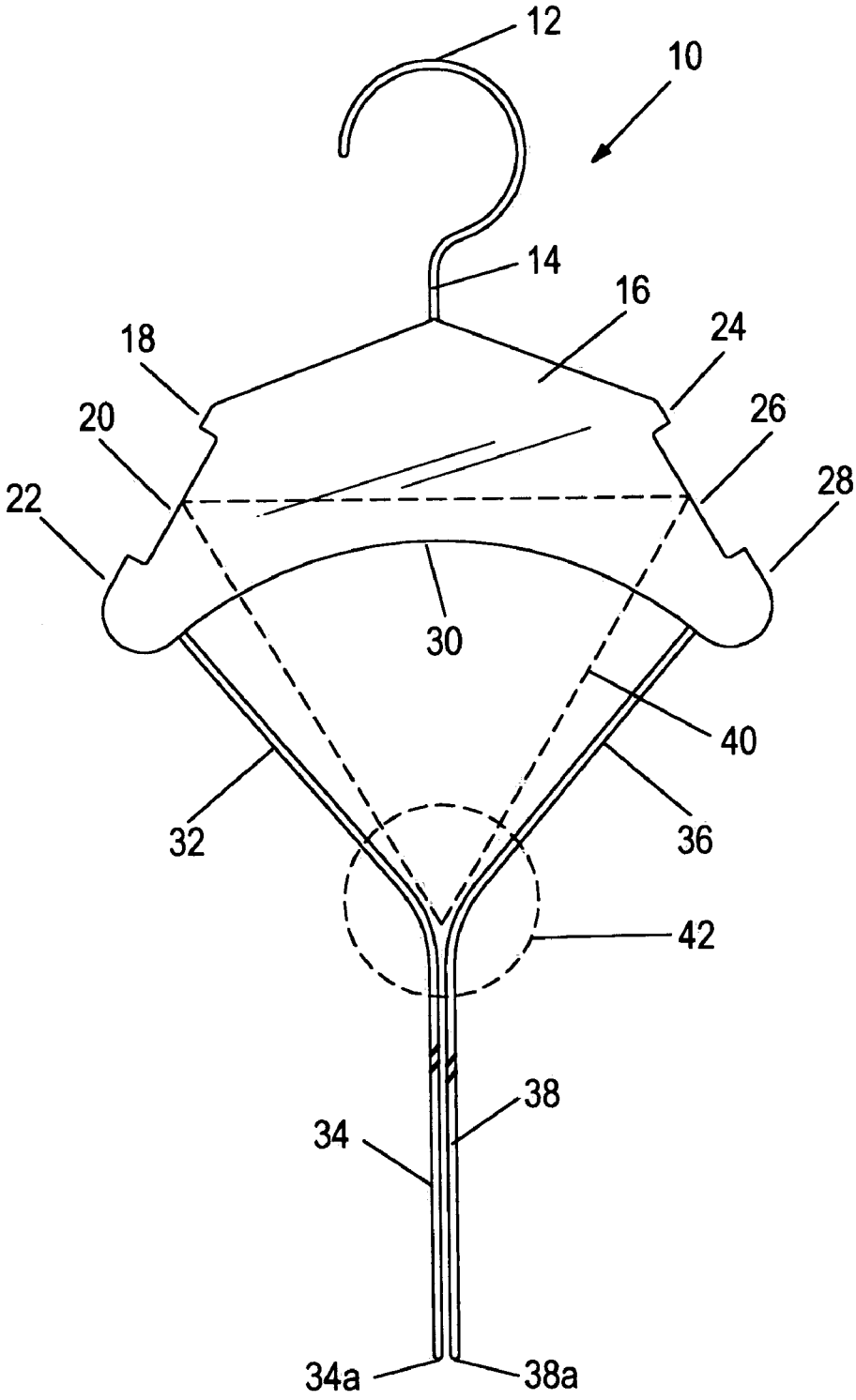
FIG. 1A shows a front view of an apparatus in accordance with a first embodiment of the present invention.

FIG. 1A shows a front view of an apparatus 10 in accordance with a first embodiment of the present. The apparatus 10 may be called a necktie-knotting device. The apparatus 10 is comprised of a loop 12 and a straight portion 14 which together may be called a rack hanger, a solid portion or collar 16, a protrusion 18, an indentation or anchor 20, a protrusion 22, a protrusion 24, an indentation 26, a protrusion 28, a bottom portion 30, and members 32, 34, 36, and 38. Members 32 and 36 may be called arms and members 34 and 38 may be called handles. In FIG. 1A a dashed circle 42 is used to show the point at which a tie would be knotted and a dashed substantially triangular shape 40 is used to show a device tie loop corresponding to the tie loop. The collar 16 serves as an anchor or a guide for a necktie when forming a tie loop. The intersection of the arms 32 and 36 and the handles 34 and 38, respectively, forms the device tie knot point 42 where a tie can be knotted.

In FIG. 1A, the intersection of the arms, such as arms 32 and 36 and the handles 34 and 38, respectively, is curved to make it easy for the apparatus, such as apparatus 10, to ease out of a tie knot. The configuration of the collar 16 and the device tie knot point 42 forms the device tie loop 40 corresponding to a tie loop created when a tie is looped around the wearer's collar. Preferably, the distance from a midpoint on the anchor 20 to a midpoint on the anchor 26 is about the same as the distance from the midpoint on the anchor 20 to the center of the device tie knot point 42, and is about the same as the distance from the midpoint on the anchor 26 to the center of the device tie knot point 42. The ends 34*a* and 38*a* of the handles 34 and 38, respectively, are typically rounded to remove any sharpness.

The collar, such as collar 16 in FIG. 1A, can be solid and can be made of plastic, wood, or some other material. A wood collar for collar 16 is preferably about 5/16 inch thick. The arch or bottom portion 30 on the collar 16 is designed to provide a bigger area for the tie to pass through. The arms, such as arms 32 and 36 and handles 34 and 38 can have a typical diameter of about 1/8 inch.

FIG. 1A shows a basic design of a necktie-knotting apparatus 10 in accordance with an embodiment of the present invention. The collar 16 can be made of any stiff material, such as molded plastic or wood. The arms/handle, such as arms 32 and 36, and handles 34 and 38, are typically made of resilient metal wire.

Figure 1B:
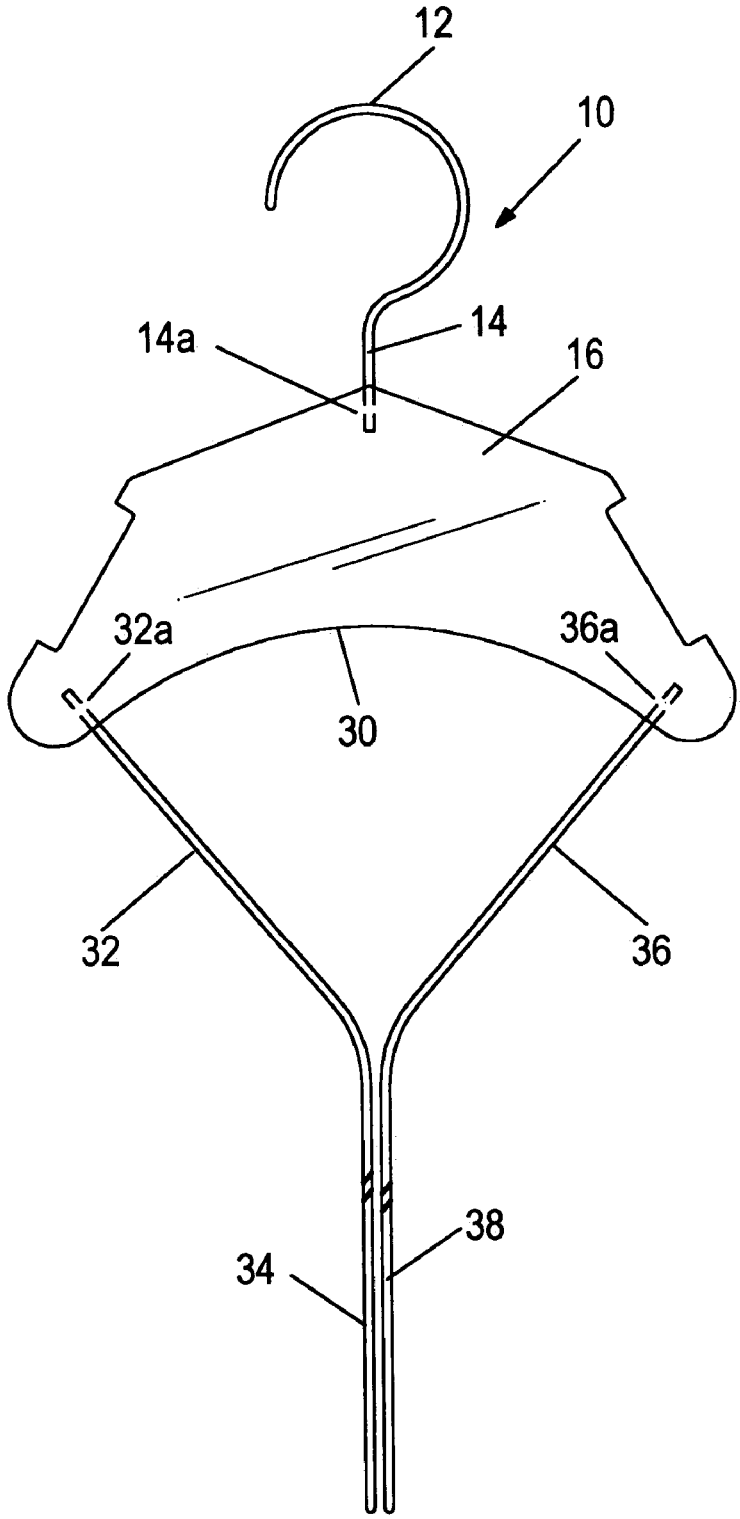
FIG. 1B shows a cross sectional view of the apparatus of FIG. 1A.

FIG. 1B shows a cross sectional view of the apparatus 10 of FIG. 1A. FIG. 1B shows that member 32 is attached to portion 32*a* and thus attached to plastic collar 16, member 36 is attached to portion 36*a* and thus attached to collar 16, and straight portion 14 is attached to portion 14*a* and thus attached to collar 16. Portions 32*a*, 36*a*, and 14*a* are part of members 32, 36, and portion 14, respectively, molded in the plastic collar 16.

Figure 2:
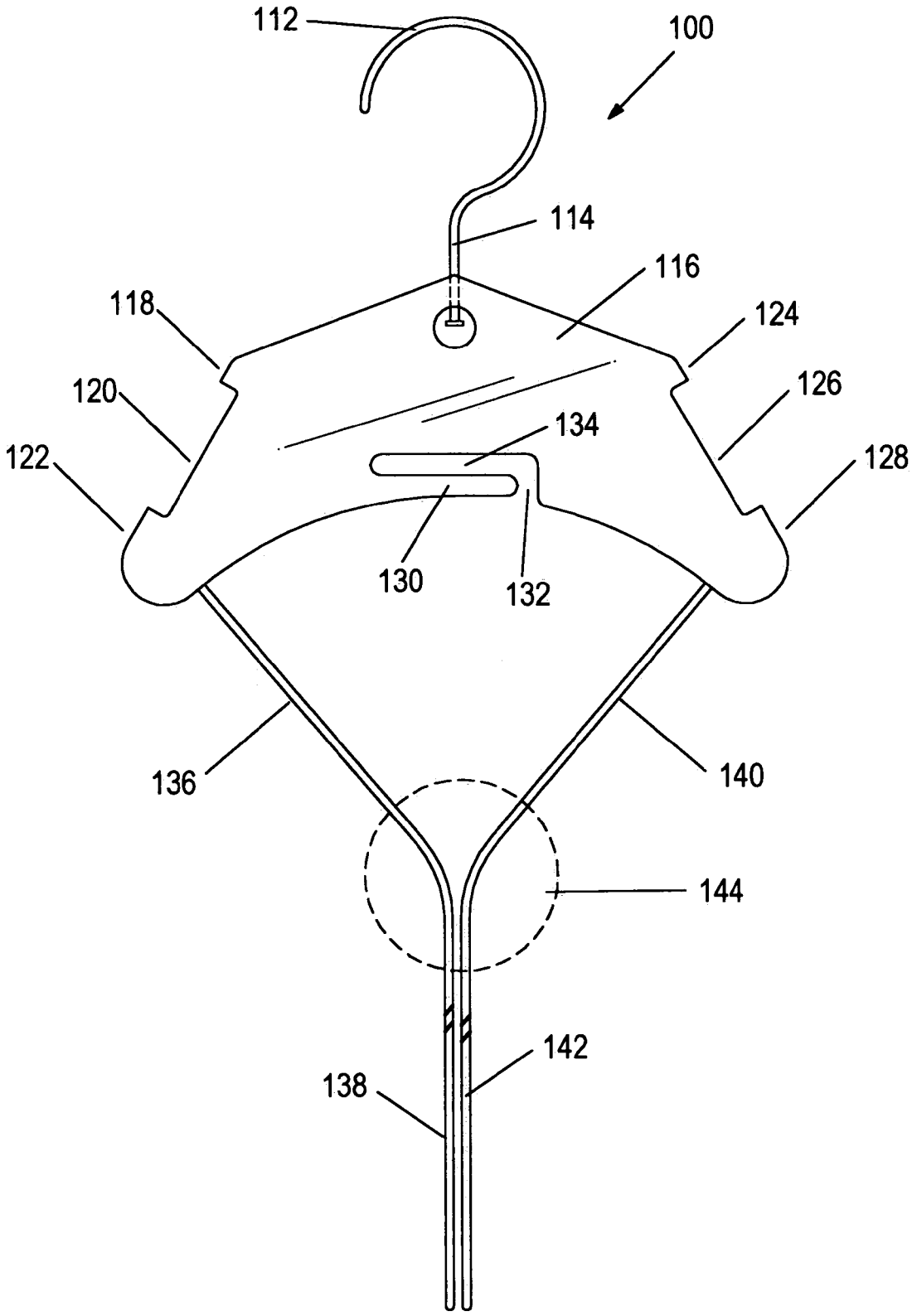
FIG. 2 shows a front view of an apparatus in accordance with another embodiment of the present invention.

FIG. 2 shows a front view of an apparatus 100 in accordance with another embodiment of the present invention. The apparatus 100 includes portions 112 and 114 which can be called a rotating rack hanger, a collar 116, a protruding portion 118, an indentation 120, protruding portion 122, protruding portion 124, indentation 126, protruding portion 128, extension 130, opening 132, channel 134, and members 136, 138, 140, and 142. Portions 112 and 114 together make up a rack hanger. Portion 116 can be called a collar. Portions 120 and 126 can be called anchors. Extension 130 can be called a necktie hanger. The extension 130 or tie hanger is built into the collar 116 so that a necktie can be hanged on the apparatus 100 prior to knotting. The opening 132 makes it easy for a tie to be hanged or remove from the necktie hanger 130.

Figure 3:
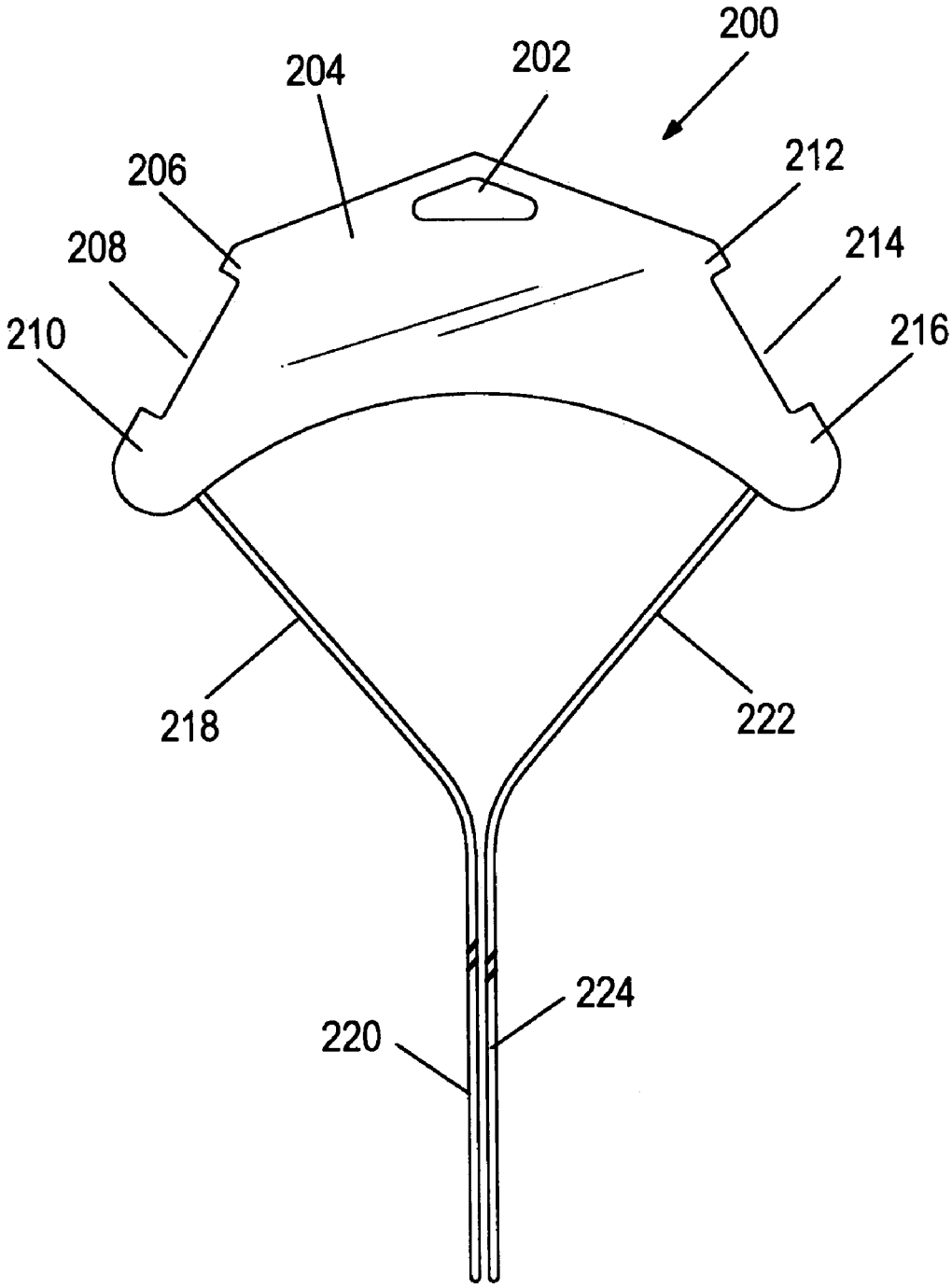
FIG. 3 shows a front view of an apparatus in accordance with another embodiment of the present invention.

FIG. 3 shows a front view of an apparatus 200 in accordance with another embodiment of the present invention. The apparatus 200 may be called a necktie knotting device. The apparatus 200 includes a portion or collar 204, an opening 202, a protrusion 206, an indentation or anchor 208, a protrusion 210, a protrusion 212, an indentation or anchor 214, a protrusion 216, a member 218, a member 220, a member 222, and a member 224. The opening 202 is for hanging the apparatus 200 on a peg.

Figure 4:
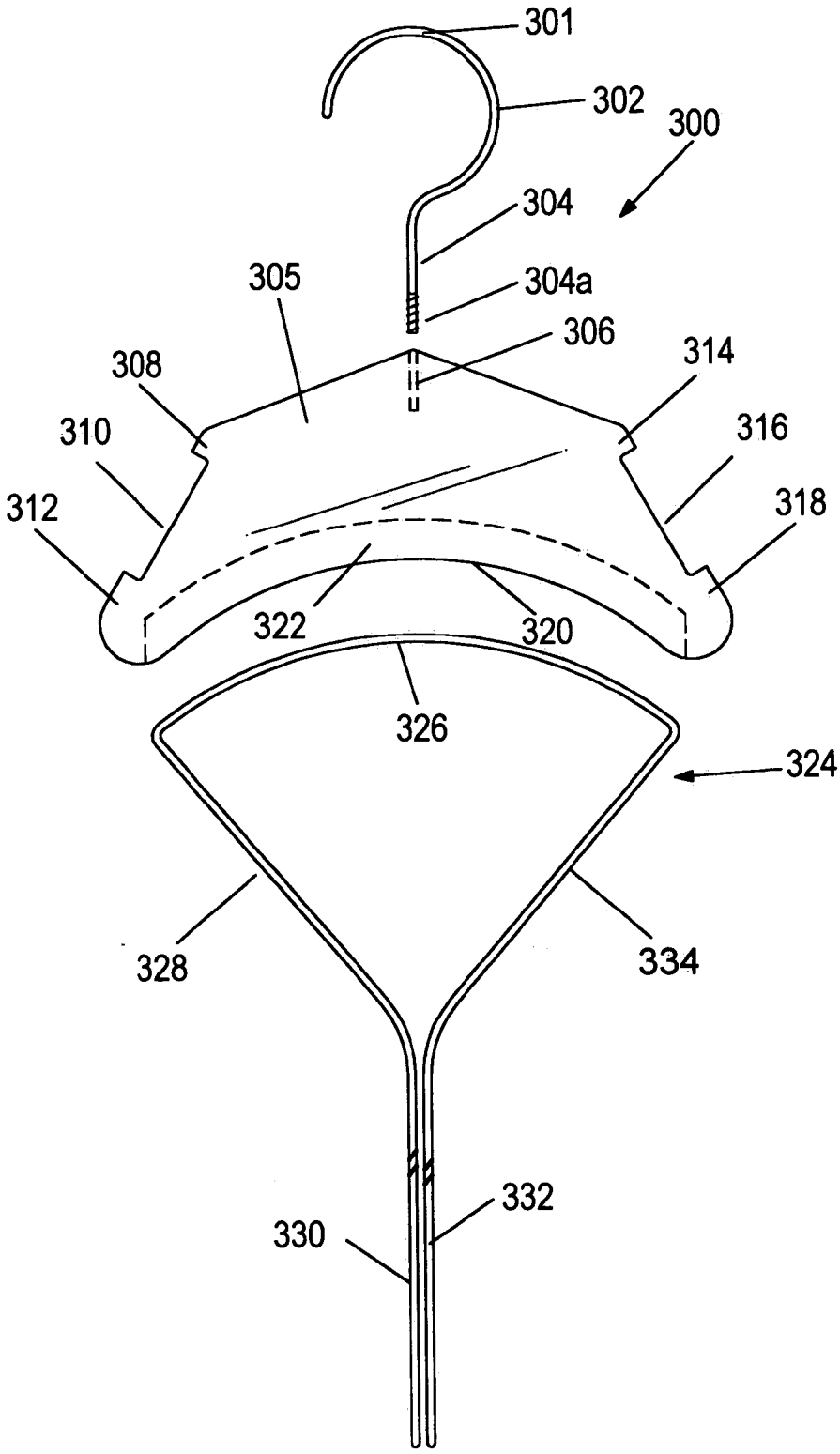
FIG. 4 shows a front view of an apparatus in accordance with another embodiment of the present invention with the apparatus in an unassembled state.

FIG. 4 shows a front view of an apparatus 300 in accordance with another embodiment of the present invention with the apparatus 300 in an unassembled state. The apparatus 300 includes a hook 301, which includes a hook portion 302 and a straight portion 304. The hook 301 may be called a rack hanger. The apparatus 300 also includes a collar 305, a protrusion 308, an indentation or anchor 310, a protrusion 312, a protrusion 314, an indentation 316, a protrusion 318, a bottom portion 320 and a slot 322. The apparatus includes a device 324 which includes members, 326, 328, 330, 332, and 334. The apparatus 300 is typically used for a wood collar. There are many ways to attach the metal wire arms, such as members 326, 328, 330, 332, and 334 to the collar 305. The apparatus 300 shows a slot 322 created on the side of the collar 305 (about 3/8" deep) where a continuous arms and handle configuration, such as device 324, can be attached. The arms/handle device 324 is inserted into the slot 322 and fixed with glue. The end 304*a* of the rack hanger 301 is threaded.

Figure 5A:
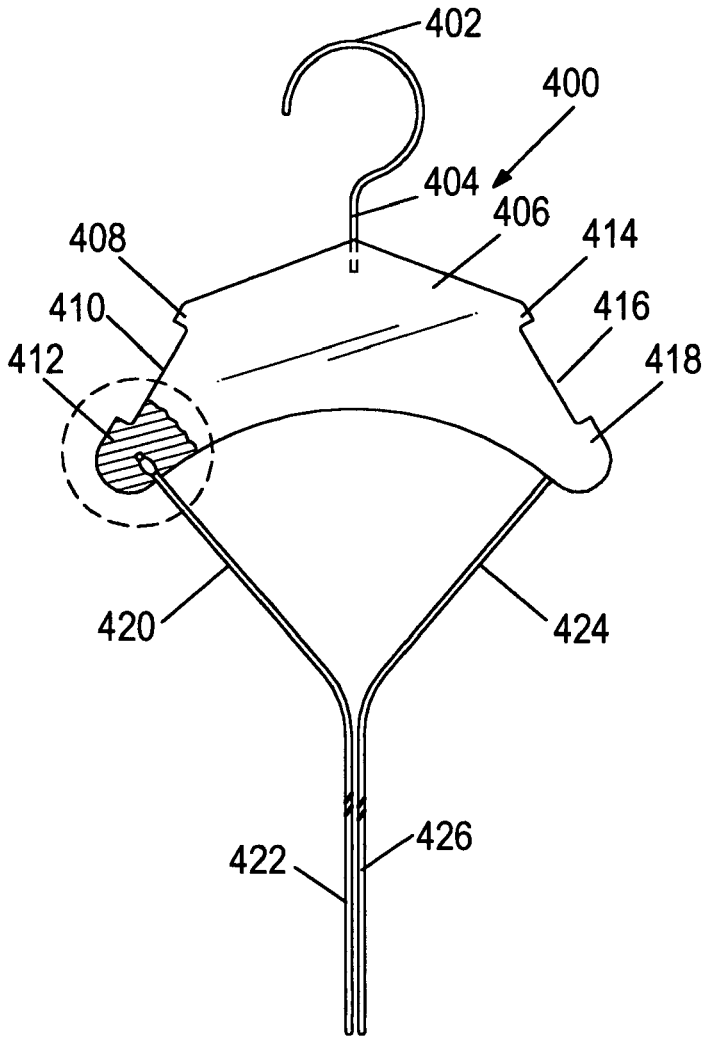
FIG. 5A shows a front view of an apparatus in accordance with another embodiment of the present invention.
Figure 5B:
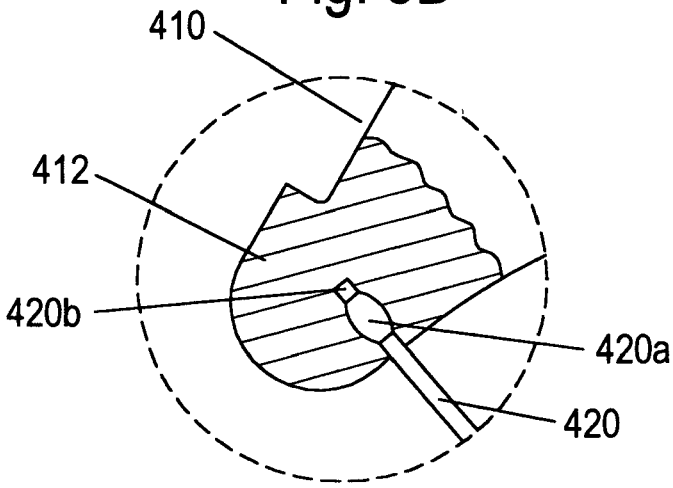
FIG. 5B shows a close-up cross sectional view of a portion of the apparatus of FIG. 5A.

FIG. 5A shows a front view of an apparatus 400. The apparatus 400 is comprised of hook portion 402, straight portion 404, portion or collar 406, protrusion 408, anchor or portion 410, protrusion 412, protrusion 414, anchor 416, protrusion 418. The apparatus 400 includes members or arms 420 and 424, and members or handles 422 and 426. FIG. 5B shows a close up view cross sectional view of a portion of the apparatus 400 of FIG. 5A. FIG. 5B shows protrusion 412, part of indentation 410, part of member 420 and end 420A and end 420B. FIG. 5A shows arms 420 and 424 attached to a wood collar 406. A hole is pre-drilled in the collar 406 where the arms 420 and 424 are to be inserted. The ends of the arms, such as end 420B, are flattened to prevent the arms from turning or twisting. The arms are inserted by force to the pre-drilled hole in the collar 406.

Figure 6:
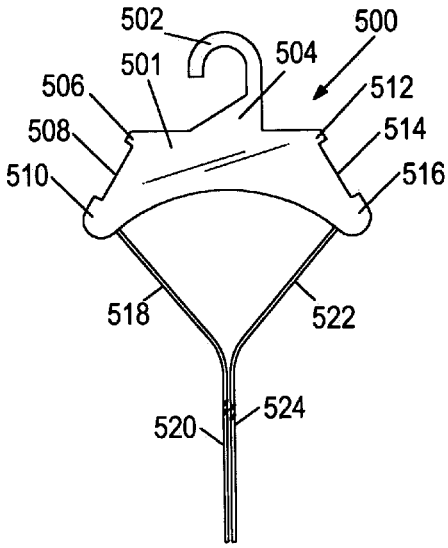
FIG. 6 shows a front view of an apparatus in accordance with another embodiment of the present invention.

FIG. 6 shows a front view of an apparatus 500 in accordance with another embodiment of the present invention. The apparatus 500 includes a portion 502, a portion 504, a protrusion 506, an indentation 508, a protrusion 510, a protrusion 512, an indentation 514, and a protrusion 516. The apparatus 500 also includes members 518, 520, 522, and 524. The apparatus portion 502 and portion 501 is made of molded plastic.

Figure 7:
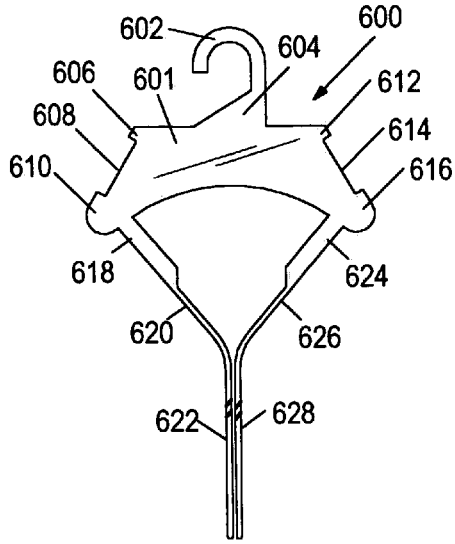
FIG. 7 shows a front view of an apparatus in accordance with another embodiment of the present invention.

FIG. 7 shows a front view of an apparatus 600 in accordance with another embodiment of the present invention. The apparatus 600 includes a portion 602, a portion 604, a protrusion 606, an indentation 608, a protruding portion 610, a protruding portion 612, an indentation 614, a protruding portion 616, members 618, 620, 622, 624, 626, and 628. The apparatus 600 in FIG. 7 may be completely made of plastic. Part of the arms may be flat at portions 618 and 624 to provide strength to the structure. The rest of the arms, portions 620 and 626 and handles, 622 and 628 are rounded.

Figure 8:
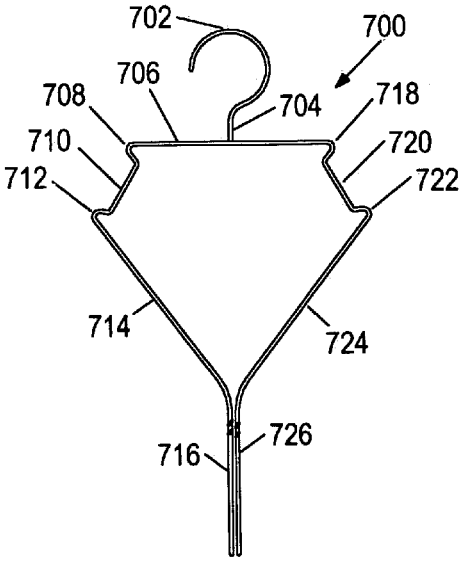
FIG. 8 shows a front view of an apparatus in accordance with another embodiment of the present invention.

FIG. 8 shows a front view of an apparatus 700 in accordance with another embodiment of the present invention. The apparatus 700 includes a portion 702, a portion 704, a portion 706, a portion 708, an indentation 710, a portion 712, a member 714, a member 716, a portion 718, a portion 720, a portion 722, a member 724, and a member 726. FIG. 8 shows the apparatus 700 made entirely of metal wires and wherein the hook rack hanger, i.e. portion 702 and portion 704 is welded to the collar 706.

Figure 9:
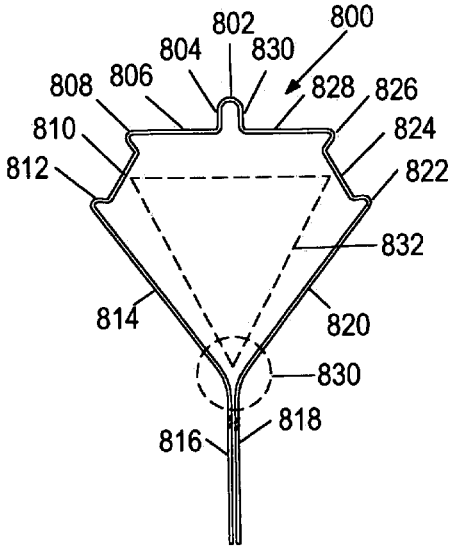
FIG. 9 shows a front view of an apparatus in accordance with another embodiment of the present invention.

FIG. 9 shows a front view of an apparatus 800 in accordance with another embodiment of the present invention. The apparatus 800 includes a portion 802, a portion 804, a portion 806, a portion 808, a portion 810, a portion 812, a portion 814, a portion 816, a portion 818, a portion 820, a portion 822, a portion 824, a portion 826, a portion 828, and a portion 830. FIG. 9 shows the apparatus 800 made of a continuous metal wire where the peg hanger 802 is formed by looping the metal wire.

Figure 10A:
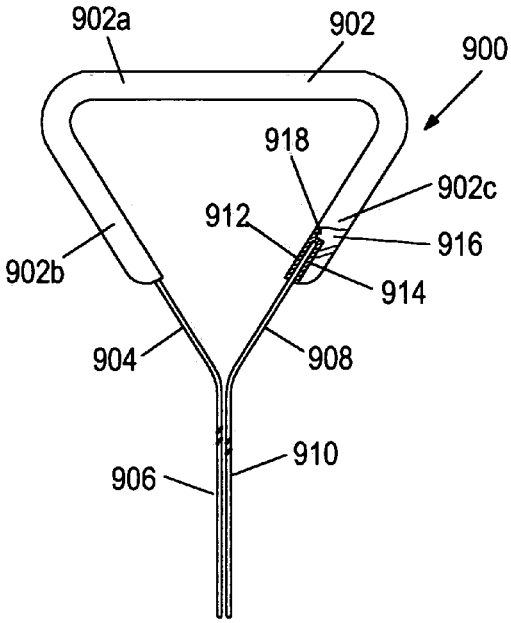
FIG. 10A shows a front view of an apparatus in accordance with another embodiment of the present invention.

FIG. 10A shows a front view of a device 900 having a collar 902 in the shape of a channel that serves as an anchor for the tie. The device 900 includes a portion 902, a member 904, a member 906, a member 908, a member 910, a member 912, a member 914, a member 916, and a member 918. The portion 902 is comprised of section 902*a*, section 902*b*, and section 902*c*.

Figure 10B:
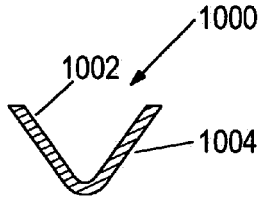
FIG. 10B shows a section of a device for use with the apparatus of FIG. 10A.

The collar 902 in FIG. 10A can be semi-circular in shape with a channel shown in FIG. 10B as an anchor or guide but the most effective to create a tie loop is a collar and device tie knot point 42 forming a triangle as in the FIG. 1A. Part of the arms 908 and 904 are molded into 902*c* and 902*b*, respectively.

FIG. 10B shows a cross-section of a device 1000 for use with the device 900 of FIG. 10A. The device 1000 includes a portion 1002 and a portion 1004.

Figure 11:
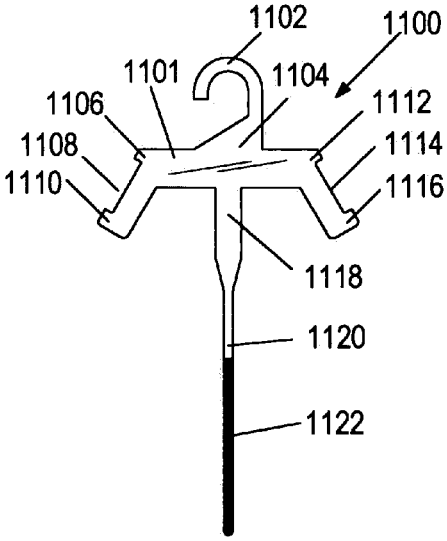
FIG. 11 shows a front view of an apparatus in accordance with another embodiment of the present invention.

FIG. 11 shows a front view of an apparatus 1100 in accordance with another embodiment of the present invention. The apparatus 1100 includes a collar 1101, a portion 1102, a portion 1104, a protrusion 1106, an indentation 1108, a protruding portion 1110, a protruding portion 1112, an indentation 1114, a protruding portion 1116, a portion 1118, a portion 1120, and a portion 1122. The apparatus 1100 may be made completely of plastic.

Figure 12:
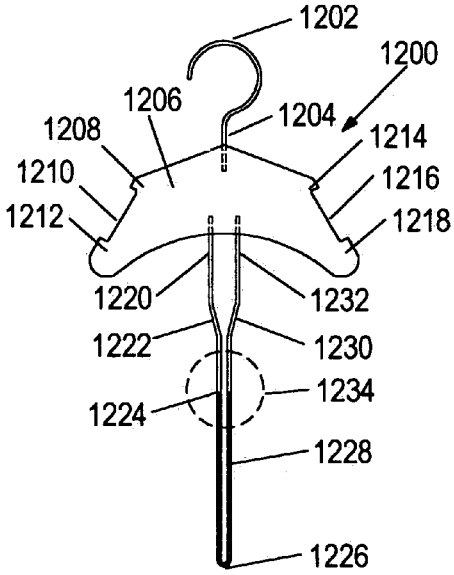
FIG. 12 shows a front view of an apparatus in accordance with another embodiment of the present invention.

FIG. 12 shows a front view an apparatus 1200 in accordance with another embodiment of the present invention. The apparatus 1200 includes a portion 1202, a portion 1204, a portion 1206, a protrusion 1208, an indentation 1210, a protrusion 1212, a protrusion 1214, an indentation 1216, a protrusion 1218, a portion 1220, a portion 1224, a portion 1226, a portion 1228, a portion 1230, and a portion 1232. A device knot tie point 1234 is also shown in FIG. 12. FIG. 12 shows a wood or plastic collar, a metal wire hook and looped shaped spine and handle piece. The spine/handle configuration is formed as a loop to widen the handle and to provide for a better hold on the tie during knotting as well as to prevent the handle form twisting. The handle part, such as handles or portions 1224, 1226, and 1228 may be painted in color to define the meeting point of the spine (portions 1220, 1222, 1230, and 1232) and handle that is the device tie knot point 1234 were the necktie is knotted.

Figure 13:
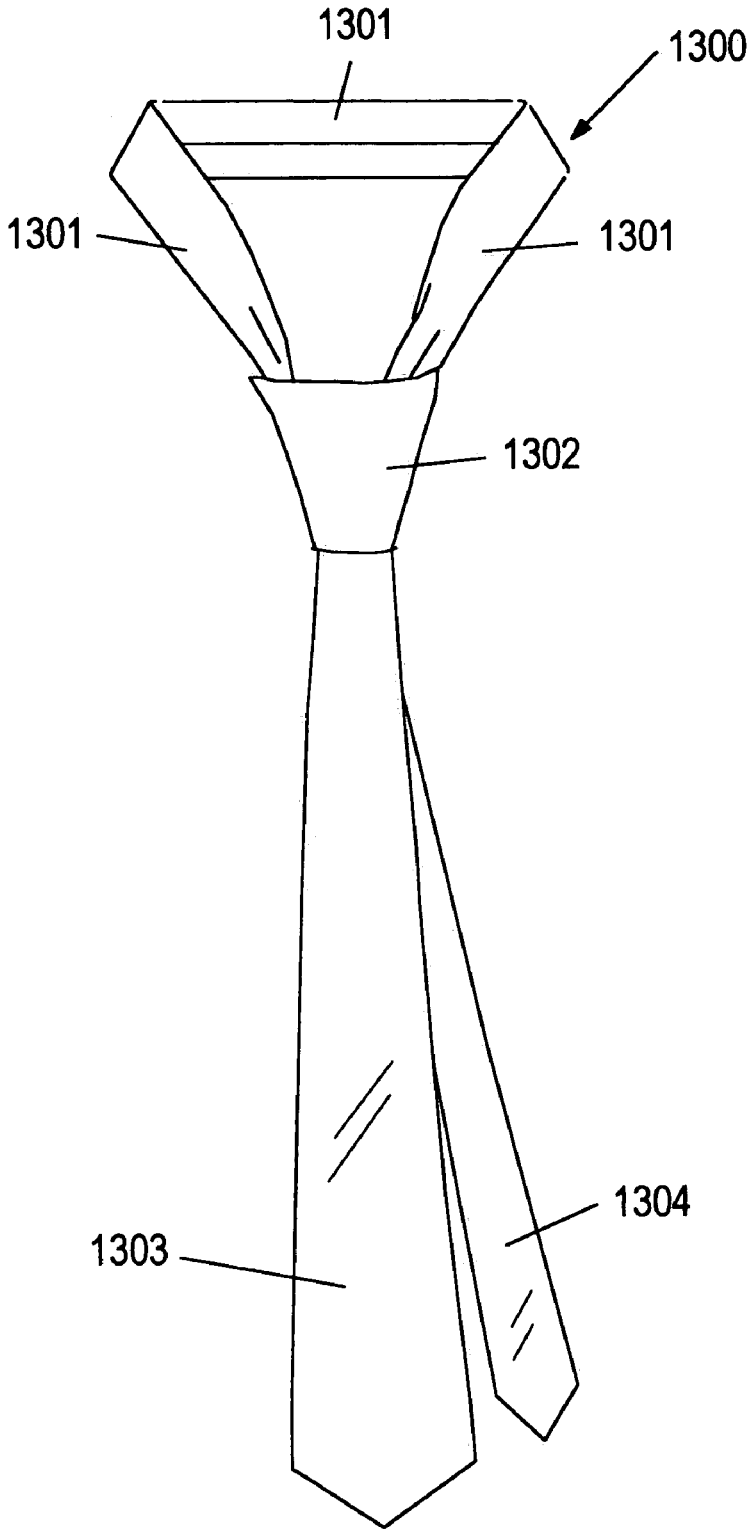
FIG. 13 shows the parts of a knotted necktie.

FIG. 13 shows the parts of a knotted necktie. The necktie 1300 comprised of the tie loop 1301, knot 1302, broad end of the tie 1303 and narrow end of the tie 1304.

FIGS. 14A–D shows using an apparatus 800 shown in FIG. 9, which has been chosen for simplicity of drawing showing how to knot the tie using the half-Windsor knot.

Figure 14A:
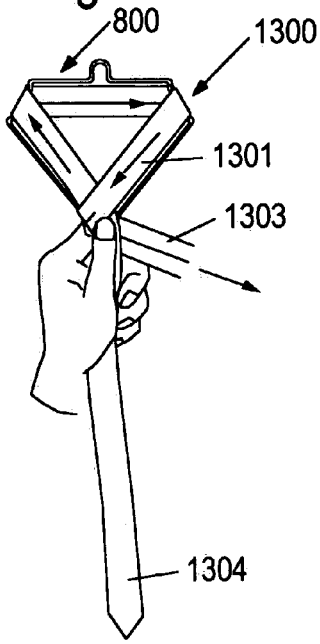
FIGS. 14A–E show front views of an apparatus shown in FIG. 9, showing how the tie is knotted on the device using half-Windsor knot and showing how to remove the device from the tie knot.
Figure 14B:
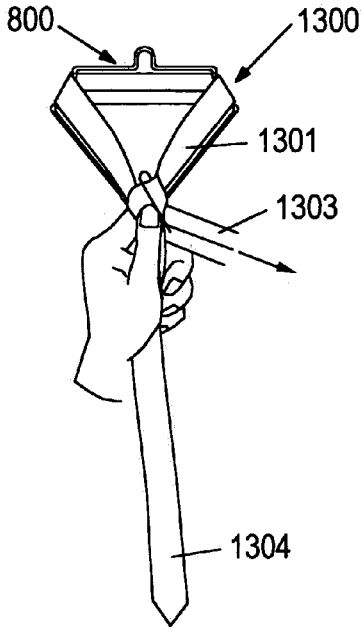
Figure 14C:
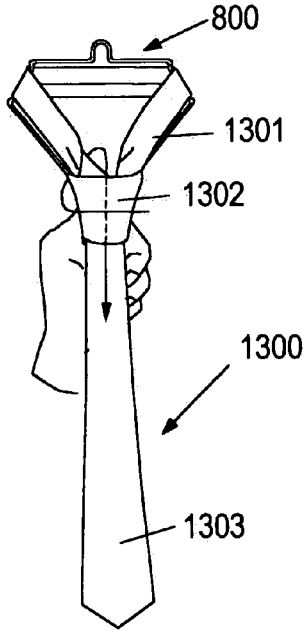
Figure 14D:
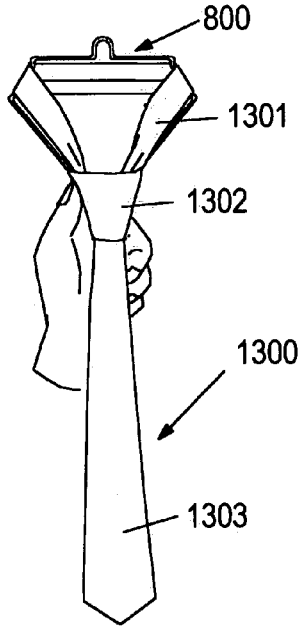
Figure 14E:
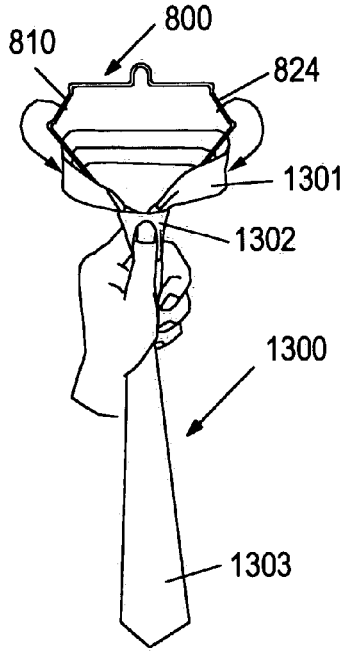

FIG. 14E shows an apparatus shown in FIG. 9 whereby the tie is knotted and removed from the apparatus 800.

FIGS. 14A–E show a front view of an apparatus 800 in accordance with another embodiment of the present invention shown in FIG. 9 and a tie 1300. In FIG. 14A the tie 1300 is shown in one state of being placed on the apparatus 800. In FIG. 14B, the tie 1300 is shown in a second state of being placed on the apparatus 800. In FIG. 14C, the tie 1300 is shown in a third state of being placed on the apparatus 800 with a final knot 1302. In FIG. 14D, the tie 1300 is shown in a fourth state of being placed on the apparatus 800. In FIG. 14E, the tie 1300 is shown in a fifth state of being taken off of the apparatus 1300.

FIGS. 14A–E shows the operation of an apparatus 800 shown in FIG. 9. Each of the apparatus, such as apparatus 10 of FIG. 1A is used as a support for tying a necktie, such as necktie 1300 of FIGS. 14A–E. The user can choose what type of knot tying technique he/she wants. FIGS. 14A to 14D show the half-Windsor knot tying technique. As shown in FIG. 14E, using the apparatus 800 shown in FIG. 9, after knotting the tie 1300 on the apparatus 800, the tie 1300 on the anchor 810 and 824 of collar 806 is removed, the knot 1302 is held and then the apparatus 800 is pulled up from the tie knot 1302.

The apparatus shown in FIGS. 1A–12 are suitable for different knotting styles. A slight change in the step of knotting such as when the tie is knotted on going to the left side opposite to what is shown in FIG. 14B and continuing opposite to what is shown in FIG. 14C, the knot 1302 cannot be unraveled by simply pulling the narrow end upwards. FIGS. 14A to 14E shows a procedure in which the knot 1302 can be unraveled when the narrow tie 1304 is pulled upward of the knot 1302.

The necktie knotting technique shown in FIGS. 14A to 14D is called half-Windsor. The procedure shown begins the tie loop from left to right with the narrow tie on the left side of the collar, such as collar 806. In practice, it does not matter whether where the broad tie is started and could depend on whether the person is left of right handed.

Determination of the length of the narrow end of the tie 1304 that will be placed on the device tie knot point 830, see label on FIG. 9. is the same as when we place the tie around our collar. There are other methods of determining the right length of a narrow tie 1303. Consistent use of the device will give one the right length of the narrow end 1304 of a tie, such as tie 1300. This is because the measurement of the device tie loop that forms the tie loop could be the approximate measurement of the neck.

The apparatus, such as apparatus 800 shown in FIG. 9, is held by holding the handle, such as handle 816 and 818 and resting the thumb on the device tie knot point 830. The necktie knotting technique shown is for the half-Windsor. Step one may be clipping a length of the narrow tie 1304 in between the left thumb and the device tie knot point 830. Running the broad tie 1303 on the collar guide 810 and 824 and back to the device tie knot point 830 as shown in FIG. 14A. Step 2 may be getting the broad tie inside the device tie loop 832 (see FIG. 9 added label) and clipping the tie, such as tie 1300 firmly with the left thumb as shown in FIG. 14B. Step 3 may be passing the broad tie 1304 over the left thumb, inside the device tie loop 832 and pass through tie partial knot 1302 that is over the left thumb. Pull the broad tie 1303 and as the tie knot 1302 is formed, release the left thumb out the still loose tie knot 1302 as shown in FIG. 14C. Step 4 may be pulling the broad tie 1303, to tighten the tie knot 1302 as shown in FIG. 14D. Step 5 may be unwrapping the tie 1301, such as tie 1300 off the anchor 810 and 824, such as collar 806 and holding the tie knot 1302 and pulling the apparatus 800 up as shown in FIG. 14E.

Most tie-knotting techniques can be done on one of the apparatus shown in FIGS. 1A–12. Knotting the tie is convenient since one typically does not need a mirror as the tie is being knotted on the apparatus before being worn. A pre-knotted necktie can be removed from the one of the apparatus in FIGS. 1A–12 and worn in a hurry. The knotted ties can be hanged, on a revolving tie hanger or a tie rack for easy pairing with the different kinds of suits. One or more of the apparatus in FIGS. 1A–12 can be hanged separately in the closet or can be hanged on to a pegged suit hanger. The hanged knotted tie looks more attractive for store display allowing the customers to immediately see how it looks when the tie is knotted and worn. The tie can be removed and hanged at home or the office to preserve its appearance. Any regular necktie can be used on any one of the apparatus shown in FIGS. 1A–12. The feeling of typing the necktie is, still experienced unlike the pre-knotted neckties that use zippers or easy attachments. Indentation purposely done by such inventions disclosed by Parietti in U.S. Pat. Nos. 5,577,778 and 6,435,571 and; U.S. Pat. No. 5,601,318 disclosed by Rusing may be done on this device by hand, so is the possibility of removal of the indentation if not desired.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus for use in knotting a necktie comprising a collar comprised of:

a left top side fixed to a right top side;

a left side fixed to the left top side, wherein the left side is at an angle of greater than ninety degrees with respect to left top side;

a right side fixed to the right top side, wherein the right side is at an angle of greater than ninety degrees with respect to the right top side;

wherein the left side lies between a first protrusion and a second protrusion, so that the left side in combination with the first and the second protrusions form a left indentation;

wherein the right side lies between a third protrusion and a fourth protrusion, so that the right side in combination with the third and fourth protrusions forms a right indentation;

wherein the left side is fixed to the left top side through the first protrusion; and and wherein the right side is fixed to the right top side through the third protrusion; and further comprising a Y-shaped device having a top portion including a first end and a second end, and a base having a third end;

wherein the first end of the portion of the Y-shaped device is fixed to the left side of the collar, substantially near the second protrusion of the collar; and wherein the second end of the top portion of the Y-shaped device is fixed to the right side of the collar, substantially near the fourth protrusion of the collar;

wherein the top portion of the Y-shaped device is comprised of first and second members, and the base of the Y-shaped device is comprised of third and fourth members; and wherein the first member is fixed to the third member so that the first member is at an angle of greater than ninety degrees with respect to the third member;

wherein the second member is fixed to that fourth member so that the second member is at an angle of greater than ninety degrees with respect to the fourth member;

and wherein the third and fourth members are substantially parallel to one another.

2. The apparatus of claim 1 further comprising a hanger loop fixed to the left top side and to the right top side of the collar substantially at the location where the left top side is fixed to the right top side.

3. The apparatus of claim 1 wherein the collar is substantially a wire frame.

4. The apparatus of claim 1 wherein the collar is substantially solid.

5. The apparatus of claim 1 wherein the top portion of the Y-shaped device is connected to the base of the Y-shaped device substantially at a knot tie point;

and wherein the distance from the center of the left side of the collar to the center of the right side of the collar, the distance from the center of the left side of the collar to the knot tie point of the Y-shaped device, and the distance from the center of the right side of the collar to the knot tie point of the Y-shaped device are approximately equal.

6. The apparatus of claim 1 wherein the first, second, third, and fourth members are elongated members;

the first and second members are substantially equal in length; and the third and fourth members are substantially equal in length.

7. An apparatus for use in knotting a necktie comprising a collar comprising of:

a left top side fixed to a right top side;

a left side fixed to the left top side, wherein the left side is at angle of greater than ninety degrees with respect to left top side;

a right side fixed to the right top side, wherein the right side is at an angle of greater than ninety degrees with respect to the right top side;

wherein the left side lies between a first protrusion and a second protrusion, so that the left side in combination with the first and the second protrusions form a left indentation;

wherein the right side lies between a third protrusion and a fourth protrusion so that the right side in combination with the third and fourth protrusions forms a right indentation;

wherein the left side is fixed to the left top side through the first protrusion; and and wherein the right side is fixed to the right top side through the third protrusion; and wherein the collar has a bottom side having an opening leading to a channel, wherein the channel is bordered by an extension;

and wherein a tie can be inserted into the channel and hung from the extension.

8. An apparatus for use in knotting a necktie comprising a collar comprised of:

a left top side fixed to a right top side;

a left side fixed to the left top side, wherein the left side is at an angle of greater than ninety degrees with respect to left top side;

a right side fixed to the right top side, wherein the right side is at an angle of greater than ninety degrees with respect to the right top side;

wherein the left side lies between a first protrusion and a second protrusion, so that the left side in combination with the first and the second protrusions form a left indentation;

wherein the right side lies between a third protrusion and a fourth protrusion, so that the right side in combination with the third and fourth protrusions forms a right indentation;

wherein the left side is fixed to the left top side through the first protrusion; and and wherein the right side is fixed to the right top side through the third protrusion; and further comprising a Y-shaped device having a top portion including a first end and a second end, and a base having a third end;

wherein the first end of the top portion of the Y-shaped device is fixed to the left side of the collar substantially near the second protrusion of the collar;

wherein the second end of the top portion of the Y-shaped device is fixed to the right side of the collar, substantially near the fourth protrusion of the collar; and wherein the collar has a bottom side;

wherein the collar is substantially solid;

wherein the collar has a slot near its bottom side;

wherein the first end of the top portion of the Y-shaped device is fixed to a first end of a connecting member and the second end of the top portion of the Y-shaped device is fixed to a second end of the connecting member;

and wherein the connecting member is inserted into the slot of the collar and fixed to the collar to fix the Y-shaped device to the collar.

9. A method comprising providing a collar comprised of:

a left top side fixed to a right top side;

a left side fixed to the left top side, wherein the left side is at an angle of greater than ninety degrees with respect to left top side;

a right side fixed to the right top side, wherein the right side is at an angle of greater than ninety degrees with respect to the right top side;

wherein the left side lies between a first protrusion and a second protrusion, so that the left side in combination with the first and the second protrusions form a left indentation;

wherein the right side lies between a third protrusion and a fourth protrusion, so that the right side in combination with the third and fourth protrusions forms a right indentation;

wherein the left side is fixed to the left top side through the first protrusion; and and wherein the right side is fixed to the right top side through the third protrusion;

and further comprising tying a neck tie by placing at least a first part of the neck tie in the left indentation and simultaneously placing at least a second part of the neck tie in the right indentation.

10. The method of claim 9 further comprising providing a hanger loop fixed to the left top side and to the right top side of the collar substantially at the location where the left top side is fixed to the right top side.

11. The method of claim 9 further comprising providing a Y-shaped device having a top portion including a first end and a second end, and a base having a third end;

wherein the first end of the top portion of the Y-shaped device is fixed to the left side of the collar, substantially near the second protrusion of the collar; and wherein the second end of the top portion of the Y-shaped device is fixed to the right side of the collar, substantially near the fourth protrusion of the collar.

12. The method of claim 11 further wherein the top portion of the Y-shaped device is comprised of first and second members, and the base of the Y-shaped device is comprised of third and fourth members; and wherein the first member is fixed to the third member so that the first member is at an angle of greater than ninety degrees with respect to the third member;

wherein the second member is fixed to the fourth member so that the second member is at an angle of greater than ninety degrees with respect fourth member;

and wherein the third and fourth members are substantially parallel to one another.

13. The method of claim 12 wherein the first, second, third, and fourth members are elongated members;

the first and second members are substantially equal in length: and the third and fourth members are substantially equal in length.

14. The method of claim 11 further wherein the collar has a bottom side;

wherein the collar is substantially solid;

wherein the collar has a slot near its bottom side;

wherein the first end of the top portion of the Y-shaped device is fixed to a first end of a connecting member and the second end of the top portion of the Y-shaped device is fixed to a second end of the connecting member;

and further comprising inserting the connecting member into the slot of the collar and fixing the connecting member to the collar to fix the Y-shaped device to the collar.

15. The method of claim 11 wherein the top portion of the Y-shaped device is connected to the base of the Y-shaped device substantially at a knot tie point;

and wherein the distance from the center of the left side of the collar to the center of the right side of the collar, the distance from the center of the left side of the collar to the knot tie point of the Y-shaped device, and the distance from the center of the right side of the collar to the knot tie point of the Y-shaped device are approximately equal.

16. The method of claim 9 further wherein the collar has a bottom side having an opening leading to a channel, wherein the channel is bordered by an extension;

and wherein a tie can be inserted into the channel and hung from the extension.

17. The method of claim 9 wherein the collar is substantially a wire frame.

18. The method of claim 9 wherein the collar is substantially solid.

* * * * *